US010259215B2

(12) United States Patent
Tanaka

(10) Patent No.: US 10,259,215 B2
(45) Date of Patent: Apr. 16, 2019

(54) LIQUID JET HEAD AND METHOD FOR MANUFACTURING LIQUID JET HEAD

(71) Applicant: Seiko Epson Corporation, Tokyo (JP)

(72) Inventor: Shuichi Tanaka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/546,997

(22) PCT Filed: Mar. 11, 2016

(86) PCT No.: PCT/JP2016/001389

§ 371 (c)(1),
(2) Date: Jul. 27, 2017

(87) PCT Pub. No.: WO2016/147634

PCT Pub. Date: Sep. 22, 2016

(65) Prior Publication Data

US 2018/0015717 A1 Jan. 18, 2018

(30) Foreign Application Priority Data

Mar. 17, 2015 (JP) ..... 2015-052890

(51) Int. Cl.
*B41J 2/045* (2006.01)
*B41J 2/16* (2006.01)
*B41J 2/14* (2006.01)

(52) U.S. Cl.
CPC ..... *B41J 2/04541* (2013.01); *B41J 2/04581* (2013.01); *B41J 2/14233* (2013.01);
(Continued)

(58) Field of Classification Search
CPC . B41J 2/04541; B41J 2/04581; B41J 2/14233
See application file for complete search history.

(56) References Cited

U.S. PATENT DOCUMENTS 7,777,328 B2 8/2010 Enomoto
8,991,981 B2 3/2015 Enomoto et al.
(Continued)

FOREIGN PATENT DOCUMENTS

CN 1748299 3/2006
CN 104339857 A 2/2015
(Continued)

OTHER PUBLICATIONS

International Search Report from PCT/JP2016/001389, dated Jun. 30, 2016, 3 pages.

*Primary Examiner* — Jason S Uhlenhake
(74) *Attorney, Agent, or Firm* — Workman Nydegger

(57) ABSTRACT

Provided are a liquid jet head with which the size-reduction can be achieved, while the resistance of wiring formed on a wiring plate such as a sealing plate is lowered, and a method for manufacturing the liquid jet head. The liquid jet head includes: a sealing plate 33 having a first surface 41 to which a pressure chamber-forming plate 29 including multiple piezoelectric elements 32 is joined and a second surface 42 which is on a side opposite from the first surface 41 and to which a drive IC 34 that outputs signals for driving the piezoelectric elements 32 is joined, wherein a lower surface-side embedded wire 51 connected to a common wire 38 common to the driving elements 32 are formed on the first surface 41 of the sealing plate 33, and the lower surface-side embedded wire 51 is at least partially embedded in the sealing plate 33.

8 Claims, 6 Drawing Sheets

(52) U.S. Cl.
CPC ..... *B41J 2/161* (2013.01); *B41J 2/1643* (2013.01); *B41J 2002/14491* (2013.01); *B41J 2202/18* (2013.01)

(56) References Cited

U.S. PATENT DOCUMENTS

| | | | | |
|---|---|---|---|---|
| 2003/0030705 | A1* | 2/2003 | Koike | B41J 2/14233 347/69 |
| 2005/0237365 | A1 | 10/2005 | Hiwada | |
| 2006/0209137 | A1 | 9/2006 | Kojima et al. | |
| 2006/0231961 | A1 | 10/2006 | Shibayama et al. | |
| 2008/0277776 | A1 | 11/2008 | Enomoto | |
| 2011/0074891 | A1 | 3/2011 | Ito | |
| 2014/0132677 | A1* | 5/2014 | Kondo | B41J 2/14233 347/81 |
| 2015/0042724 | A1 | 2/2015 | Enomoto et al. | |
| 2016/0263887 | A1* | 9/2016 | Tanaka | B41J 2/14233 |
| 2016/0276571 | A1* | 9/2016 | Tanaka | B41J 2/14201 |

FOREIGN PATENT DOCUMENTS

| | | | |
|---|---|---|---|
| EP | 0289347 | A2 | 11/1988 |
| JP | 2003-304050 | A | 10/2003 |
| JP | 2005-050885 | A | 2/2005 |
| JP | 2007-142026 | A | 6/2007 |
| JP | 2010-069750 | A | 4/2010 |
| JP | 2011-115972 | A | 6/2011 |
| JP | 2013-030789 | A | 2/2013 |
| JP | 2014083705 | | 5/2014 |
| WO | 2007086498 | A1 | 8/2007 |
| WO | 2012176874 | | 12/2012 |

* cited by examiner

[Fig. 1]
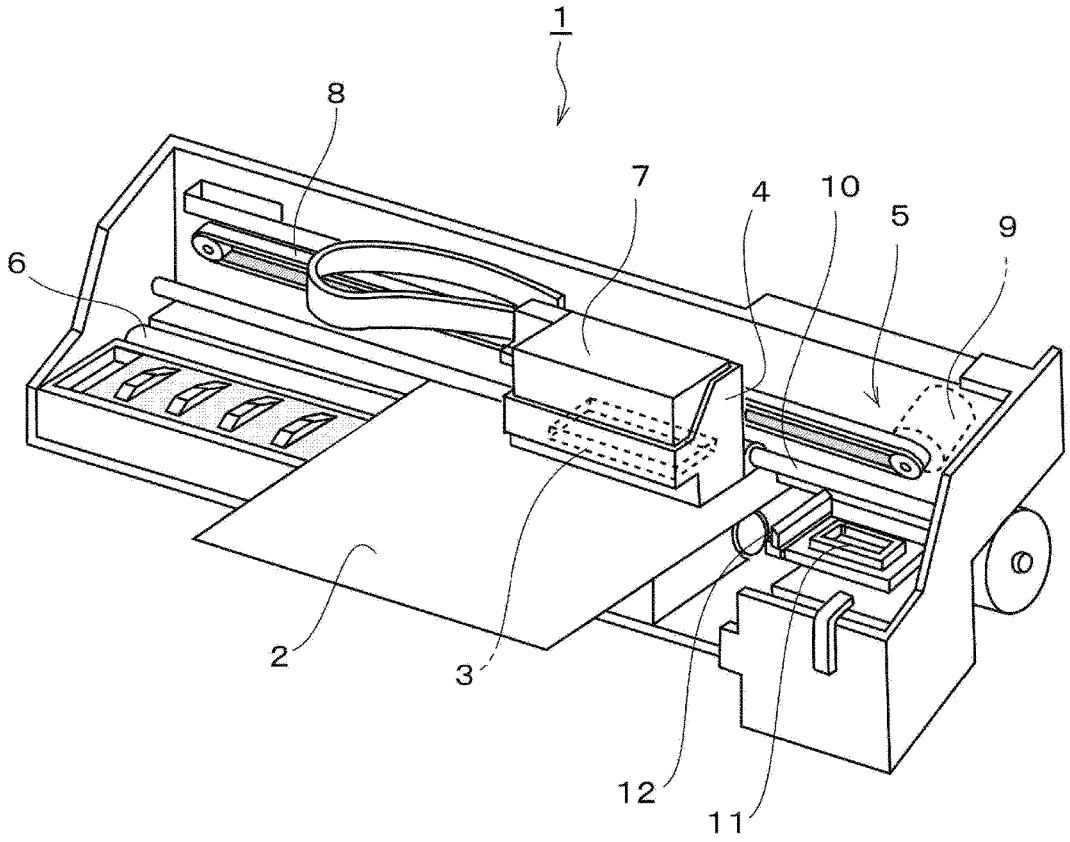

[Fig. 2]
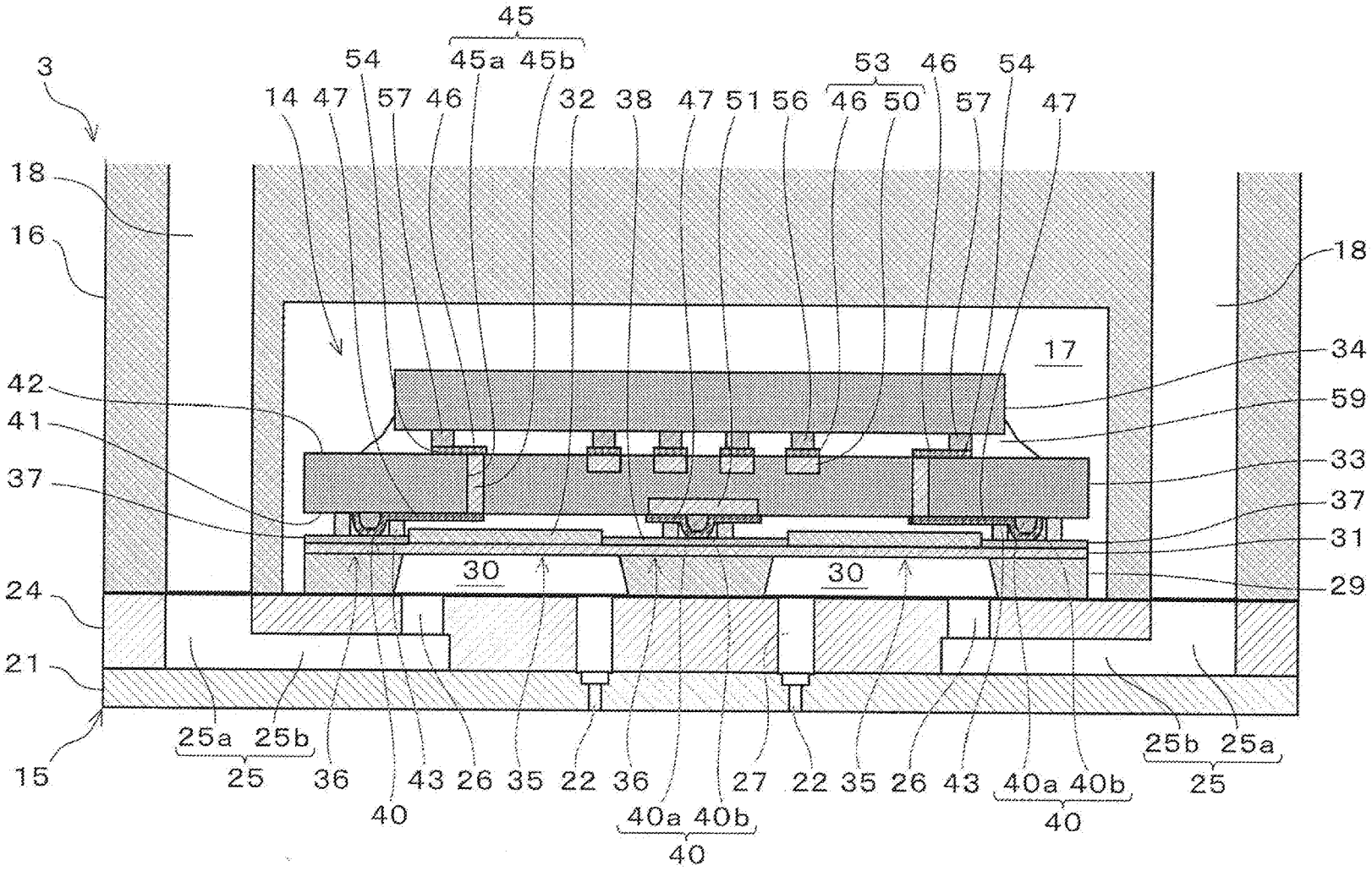

[Fig. 3]
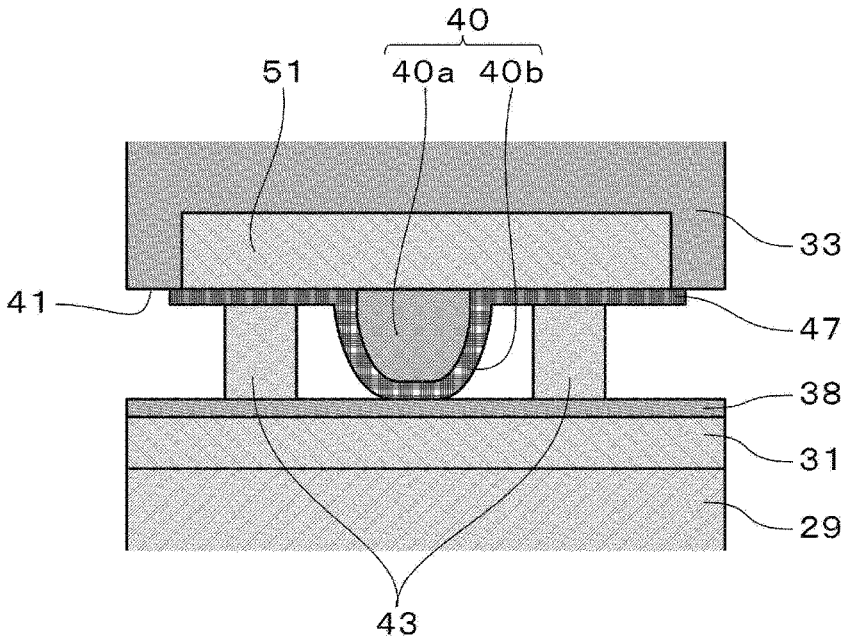
[Fig. 4]
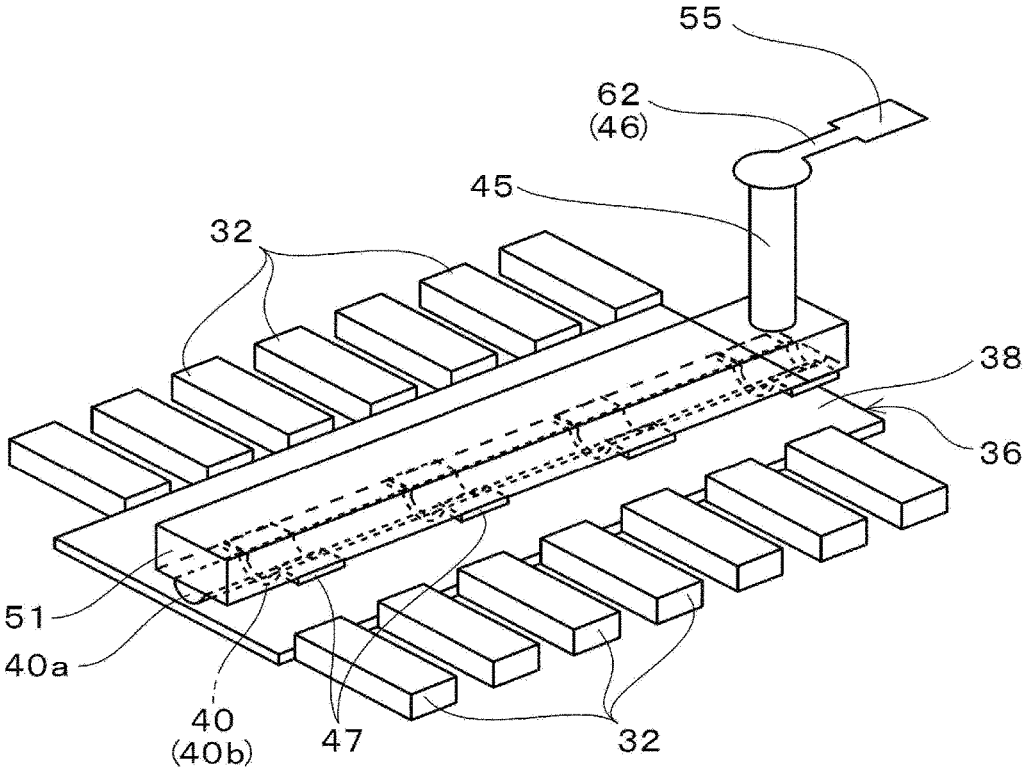

[Fig. 5]
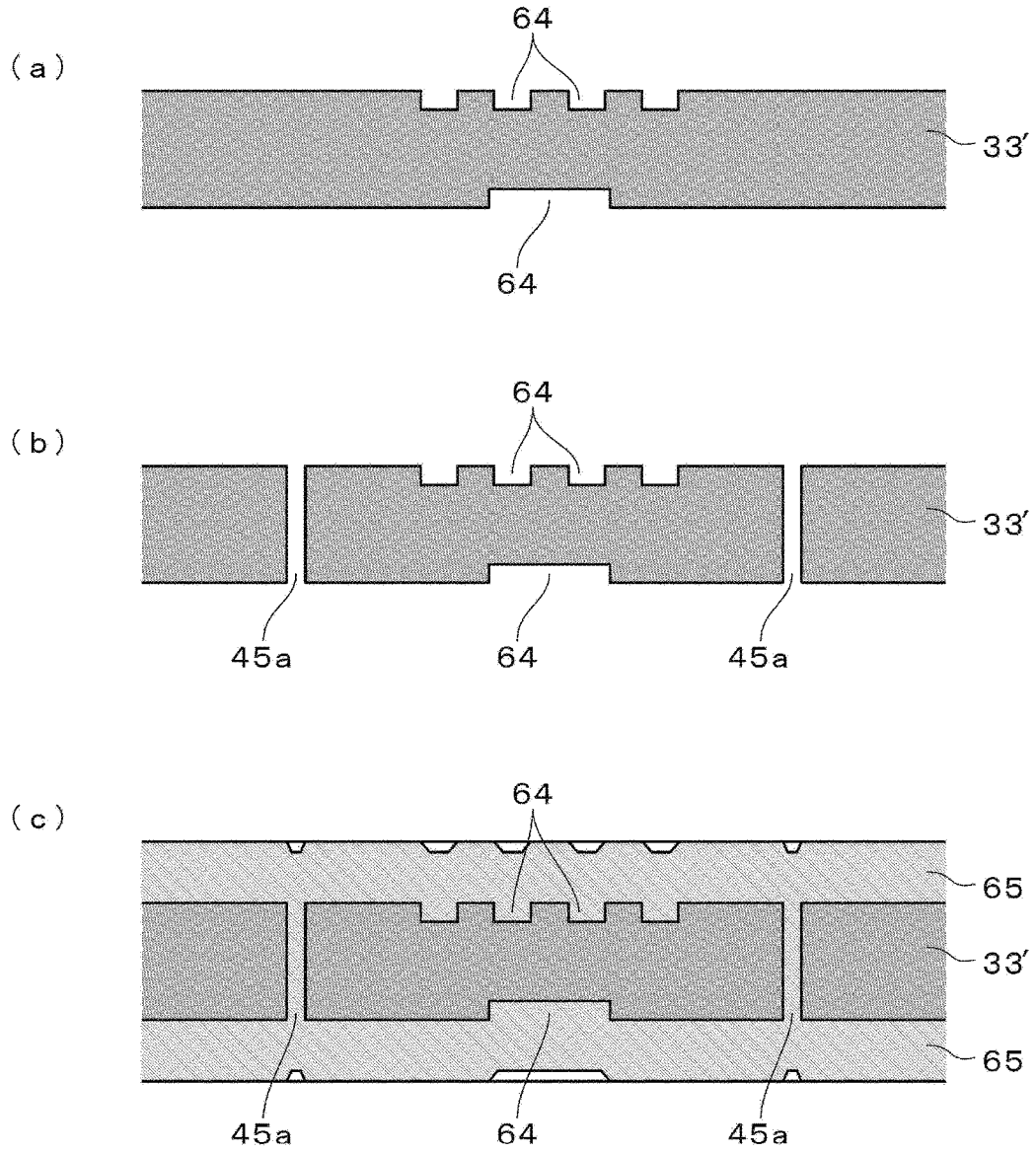

[Fig. 6]
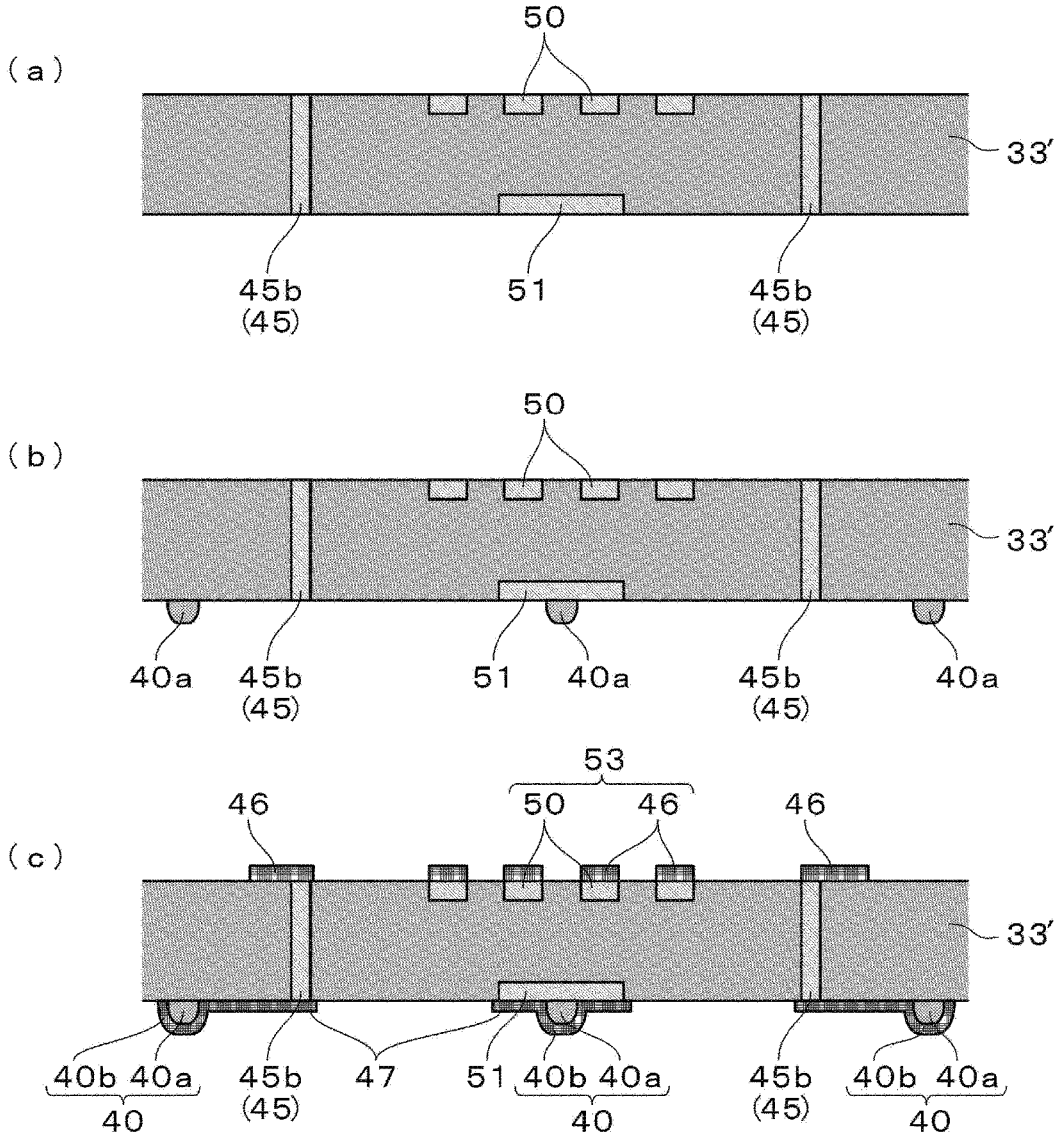

[Fig. 7]
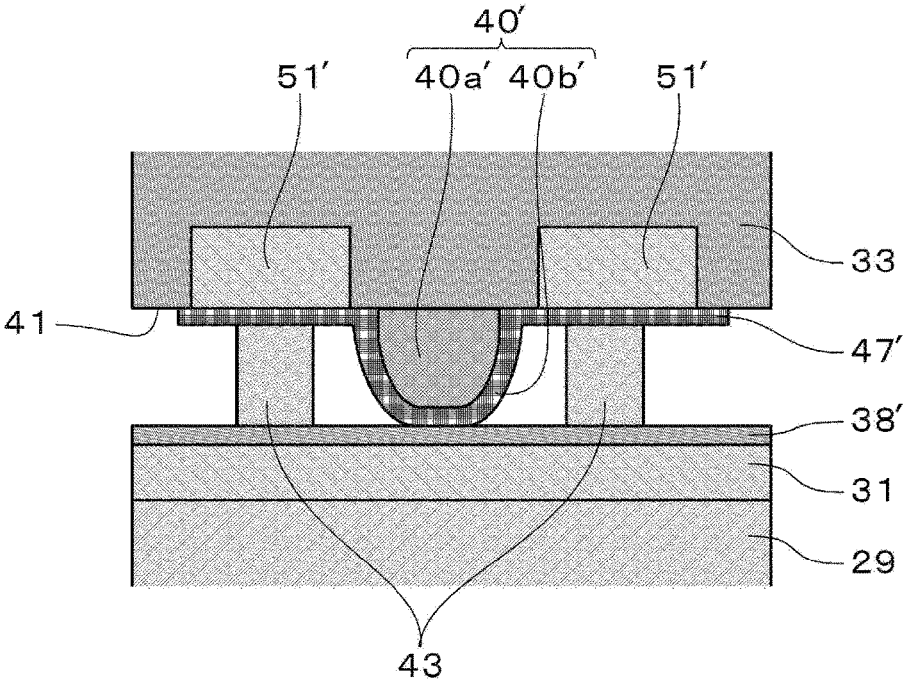
[Fig. 8]
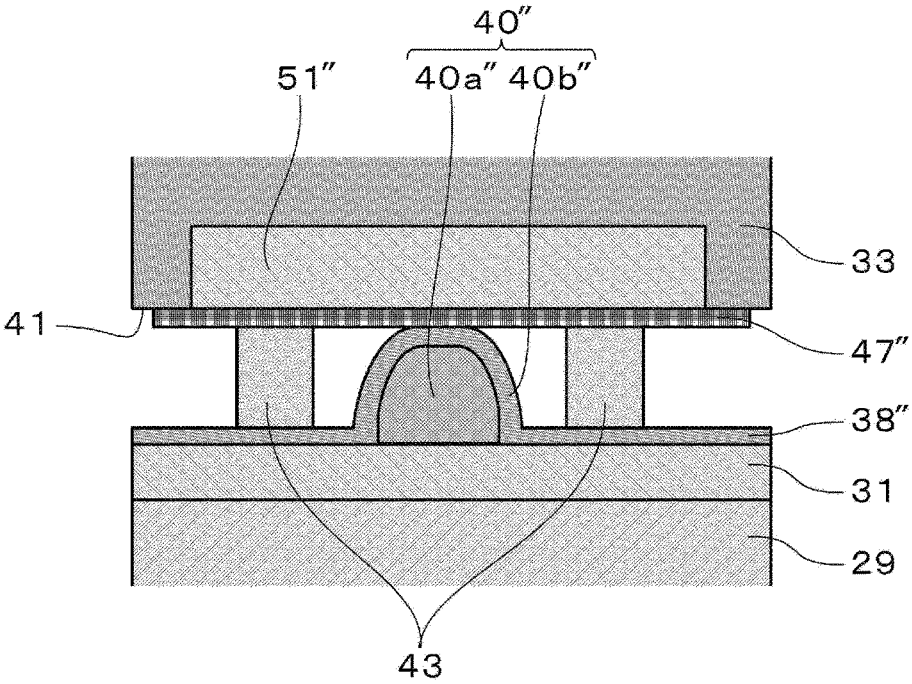

LIQUID JET HEAD AND METHOD FOR MANUFACTURING LIQUID JET HEAD

TECHNICAL FIELD

The present invention relates to a liquid jet head including a wiring plate in which wiring connected to a drive IC is formed, and a method for manufacturing the liquid jet head.

BACKGROUND ART

Examples of liquid jet devices equipped with liquid jet heads include image recording devices such as inkjet-type printers and inkjet-type plotters. Recently, liquid jet devices have been applied also to various manufacturing devices by taking such an advantage that extremely small amounts of liquid can be landed precisely on predetermined positions. For example, liquid jet devices have been applied to display manufacturing devices for manufacturing color filters of liquid crystal displays and the like, electrode forming devices for forming electrodes of organic electroluminescence (EL) displays, surface emission displays (FEDs), and the like, and chip manufacturing devices for manufacturing biochips (biochemical elements). Here, a recording head for an image recording device jets liquid ink, and a coloring material jet head for a display manufacturing device jets solutions of coloring materials of R (Red), G (Green), and B (Blue). Meanwhile, an electrode material jet head for an electrode forming device jets a liquid electrode material, and a bioorganic matter jet head for a chip manufacturing device jets a solution of bioorganic matter.

Each of the above-described liquid jet heads are formed by stacking a pressure chamber-forming plate, piezoelectric elements (a type of driving element), a sealing plate, and the like. Here, pressure chambers communicating with nozzles are formed in the pressure chamber-forming plate, and the piezoelectric elements cause change in pressure of the liquid in the pressure chambers. In addition, the sealing plate is arranged with a space provided between the sealing plate and the piezoelectric elements. The above-described piezoelectric elements are driven by drive signals supplied by a drive IC (also referred to as a driver IC). The above-described piezoelectric elements are, for example, formed by stacking individual electrode layers provided for individual pressure chambers, a piezoelectric layer of lead zirconate titanate (PZT) or the like, and a common electrode layer common to the pressure chambers. When a drive IC (also referred to as a driver IC) supplies voltage signals to the individual electrode layers, the piezoelectric layer deforms in response to the voltage signals to cause changes in pressure in the pressure chambers. By utilizing the changes in pressure, the liquid jet head jets liquid through nozzles. Here, the drive IC is provided outside the liquid jet head in related art. For example, a drive IC provided to a flexible plate to be connected to a liquid jet head is known (for example, see PTL 1).

SUMMARY OF INVENTION

Technical Problem

With the recent size-reduction of liquid jet head, a technology has been developed by which a drive IC is joined onto a sealing plate covering piezoelectric elements. In this configuration, wiring that supplies power to a common electrode layer of the piezoelectric elements is formed on a surface of the sealing plate on one side (on a pressure chamber-forming plate side). Incidentally, when the number of nozzles increases with the increase in density of nozzles, the power supplied to the common electrode layer increases. For this reason, an attempt has been made to lower the electrical resistance (hereinafter, simply referred to as resistance) of the wiring. However, when the width of the wiring is increased to lower the resistance of the wiring, the wiring region increases and, in turn, the size of the sealing plate increases. In addition, it is conceivable that the thickness of the wiring may be increased. However, if the wiring protrudes from the sealing plate toward the piezoelectric elements, the deformation of the piezoelectric elements facing the sealing plate may be inhibited. For this reason, it is necessary to increase the distance between the piezoelectric elements and the sealing plate. This makes it difficult to achieve the size-reduction of a liquid jet head.

The invention has been made in view of the above-described circumstances, and an object of the invention is to provide a liquid jet head with which the size-reduction can be achieved, while the resistance of wiring formed on a wiring plate such as a sealing plate is lowered, and a method for manufacturing the liquid jet head.

Solution to Problem

A liquid jet head of the invention is proposed to achieve the above-described object, and includes a wiring plate having a first surface to which a driving element-forming plate including multiple driving elements is connected and a second surface which is on a side opposite from the first surface and on which a drive IC that outputs signals for driving the driving elements is provided, wherein wiring connected to a common electrode common to the driving elements is formed on the first surface of the wiring plate, and the wiring is at least partially embedded in the wiring plate.

With this configuration, the wiring is embedded in the wiring plate. Hence, the cross-sectional area of the wiring can be increased without increasing the width of the wiring and the dimension (height) of the wiring from the surface of the wiring plate. This makes it possible to lower the resistance of the wiring. In addition, since the width of the wiring can be reduced as much as possible, the degree of freedom of the wiring layout increases and, in turn, the wiring region can be made smaller. Consequently, the size-reduction of the liquid jet head can be achieved. Moreover, since the height of the wiring can be reduced, it is possible to suppress the disadvantageous inhibition of the deformation of the piezoelectric elements.

In addition, in the above-described configuration, the wiring is preferably at least partially covered with a metal layer.

With this configuration, it is possible to suppress change in electrical characteristics of the wiring due to environmental change. In addition, it is possible to suppress a break of the wiring due to migration or the like. This makes it possible to provide a highly-reliable liquid jet head.

Moreover, in each of the above-described configurations, the wiring and the common electrode are preferably connected to each other by bump electrodes.

With this configuration, it is possible to suppress concentration of the power supplied to the common electrode on one point. This makes it possible to suppress the variation in the power supplied to the piezoelectric elements through the common electrode. Consequently, jetting characteristics of the liquid jetted through the nozzles can be made uniform.

In addition, in the above-described configuration, each of the bump electrodes preferably includes a resin having elasticity and a conductive layer covering at least part of a surface of the resin.

With this configuration, the bump electrodes can be provided with elasticity, and more reliable electrical connection can be provided by the bump electrodes.

Moreover, in the above-described configuration, it is preferable that the resin be formed on a surface of the wiring, and the conductive layer be connected to the wiring at a position offset from the resin.

In this configuration, the bump electrodes are formed just on the wiring. Hence, the wiring distance of the conductive layer can be shortened, and the wiring resistance can be lowered in comparison with a case where bump electrodes are provided separately from the wiring. In addition, by employing a metal layer as the conductive layer, the conductive layer and the metal layer covering the wiring can be formed in the same step. Consequently, the wiring plate becomes easier to manufacture, and the wiring plate can be formed at low costs.

In addition, in the above-described configuration, it is preferable that the wiring be formed in two rows, the resin be formed between the two rows of the wiring, and the conductive layer be connected to at least one of the two rows of the wiring at a position offset from the resin.

According to this configuration, the resin is formed at a position offset from the wiring. Hence, the adhesion between the resin and the wiring plate can be improved. In addition, by employing a metal layer as the conductive layer, the conductive layer and the metal layer covering the wiring can be formed in the same step. Consequently, the wiring plate becomes easier to manufacture, and the wiring plate can be formed at low costs.

In addition, in the above-described configuration, it is preferable that the resin be formed at a position facing the wiring, and the conductive layer be the common electrode.

According to this configuration, the bump electrodes are formed at positions facing the wiring. Hence, the wiring distance can be shortened, and the wiring resistance can be lowered in comparison with a case where bump electrodes are connected to terminals provided separately from the wiring. In addition, since the conductive layer can be formed of the common electrode, the driving element-forming plate becomes easier to manufacture, and the driving element-forming plate can be formed at lower costs in this case than in a case where an additional conductive layer is formed.

Moreover, in each of the above-described configurations, it is preferable that the wiring plate include a penetrating wire made of a conductor and formed inside a through-hole penetrating the wiring plate, and the wiring be connected to the penetrating wire on the first surface.

With this configuration, the connection between the first surface and the second surface can be provided at any position in the wiring plate, and wires can be formed on both surfaces. Hence, the degree of freedom of the wiring layout can be increased.

In addition, a method for manufacturing a liquid jet head of an aspect of the invention is a method for manufacturing a liquid jet head including a wiring plate having a first surface to which a driving element-forming plate including multiple driving elements is joined and a second surface which is on a side opposite from the first surface and to which a drive IC that outputs signals for driving the driving elements is joined, the wiring plate including wiring connected to a common electrode common to the driving elements and a penetrating wire which provides connection between the first surface and the second surface, the method comprising:

wiring plate processing of forming a recessed portion recessed in a plate thickness direction on the first surface of the wiring plate and forming a through-hole penetrating the wiring plate; and wiring formation of forming the wiring by embedding a conductive material in the recessed portion and forming the penetrating wire by embedding the conductive material in the through-hole.

According to this method, the wiring embedded in the wiring plate can be formed. This makes it possible to increase the cross-sectional area of the wiring without increasing the width of the wiring or the dimension (height) of the wiring from the surface of the wiring plate. In addition, since the wiring and the penetrating wire can be formed in the same step, the wiring plate becomes easier to manufacture. Moreover, the wiring plate can be formed at low costs.

In the above-described method, the wiring formation preferably includes forming the conductive material in the recessed portion and the through-hole by an electrolytic plating method.

This method makes it possible to more easily form the wiring and the penetrating wire. Consequently, the wiring plate becomes much easier to manufacture. In addition, the wiring plate can be fabricated at lower costs.

In addition, in the above-described method, the wiring formation preferably includes forming the conductive material in the recessed portion and the through-hole by printing.

This method makes it possible to more easily form the wiring and the penetrating wire. Consequently, the wiring plate becomes much easier to manufacture. In addition, the wiring plate can be fabricated at lower costs.

Moreover, in the above-described method, it is preferable that the conductive material be an electrically conductive paste, and the wiring formation include hardening the conductive material.

This method makes it possible to lower the resistance of the wiring and the penetrating wire.

BRIEF DESCRIPTION OF DRAWINGS

FIG. 1 is a perspective view for describing a configuration of a printer.

FIG. 2 is a cross-sectional view for describing a configuration of a recording head.

FIG. 3 is an enlarged cross-sectional view of a main portion of an electronic device.

FIG. 4 is a perspective view for describing a connection structure between a lower surface-side embedded wire and a common wire.

FIG. 5 shows cross-sectional views for describing a process of manufacturing a sealing plate.

FIG. 6 shows cross-sectional views for describing the process of manufacturing the sealing plate.

FIG. 7 is an enlarged cross-sectional view showing a main portion of an electronic device of a second embodiment.

FIG. 8 is an enlarged cross-sectional view showing a main portion of an electronic device of a third embodiment.

DESCRIPTION OF EMBODIMENTS

Hereinafter, embodiments for carrying out the invention are described with reference to the attached drawings. Note that, in the embodiments described below, various limitations are provided as specific preferred examples of the invention. However, the scope of the invention is not limited to any of these embodiments, unless it is stated that the invention is limited to the embodiment in the description below. In addition, an inkjet-type printer (hereinafter, printer), which is a type of liquid jet device, on which an inkjet-type recording head (hereinafter, recording head), which is a type of liquid jet head according to the invention, is mounted is taken as an example in the following description.

A configuration of a printer 1 is described with reference to FIG. 1. The printer 1 is a device that jets ink (a type of liquid) onto a surface of a recording medium 2 (a type of landing target) such as recording paper to record an image or the like. This printer 1 includes a recording head 3, a carriage 4 to which the recording head 3 is attached, a carriage-moving mechanism 5 that moves the carriage 4 in a main scanning direction, a transfer mechanism 6 that transports the recording medium 2 in a sub-scanning direction, etc. Here, the ink is stored in an ink cartridge 7 serving as a liquid supply source. The ink cartridge 7 is detachably mounted on the recording head 3. Note that it is also possible to employ a configuration in which the ink cartridge is disposed on a main body side of the printer, and the ink is supplied from the ink cartridge through an ink supply tube to the recording head.

The carriage-moving mechanism 5 includes a timing belt 8. The timing belt 8 is driven by a pulse motor 9 such as a DC motor. Accordingly, when the pulse motor 9 is actuated, the carriage 4 reciprocates in the main scanning direction (a width direction of the recording medium 2), while being guided by a guide rod 10 provided across the printer 1. The position of the carriage 4 in the main scanning direction is detected by a linear encoder (not-illustrated), which is a type of positional information detector. The linear encoder transmits a detected signal, i.e., an encoder pulse (a type of positional information) to a control unit of the printer 1.

In addition, a home position serving as a starting point of the scanning by the carriage 4 is set in an end portion region outside a recording region within which the carriage 4 can moves. In the home position, a cap 11 that seals nozzles 22 formed on a nozzle surface (nozzle plate 21) of the recording head 3 and a wiping unit 12 that wipes out the nozzle surface are arranged in this order from the end portion side.

Next, the recording head 3 is described. FIG. 2 is a cross-sectional view for describing a configuration of the recording head 3. FIG. 3 is view for describing a joint portion between a lower surface-side embedded wire 51 and a common wire 38, and is an enlarged cross-sectional view of a main portion of an electronic device 14. FIG. 4 is a schematic diagram for describing a connection structure between the lower surface-side embedded wire and the common wire, and is a perspective view in which a vibration plate 31 is viewed from the above (from a sealing plate 33 side). Note that the vibration plate 31, the sealing plate 33, and the like are omitted in FIG. 4, but only wires and piezoelectric elements 32 are shown in FIG. 4.

As shown in FIG. 2, in the recording head 3 of this embodiment, the electronic device 14 and a flow path unit 15 stacked on each other are attached to a head case 16. Note that, for convenience, the direction in which the members are stacked is taken as a vertical direction in the following description.

The head case 16 is a box-shaped member made of a synthetic resin. Reservoirs 18 from which ink is supplied to pressure chambers 30 are formed inside the head case 16. The reservoirs 18 are spaces in which ink common to the multiple pressure chambers 30 arranged side by side is stored, and the number of the reservoirs 18 formed is two, which is equal to the number of the rows of the pressure chambers 30, which are arranged side by side in two rows. Note that, in an upper portion of the head case 16, ink introducing paths (not-illustrated) are formed through which the ink from the ink cartridge 7 is introduced into the reservoirs 18. In addition, on a lower surface side of the head case 16, a housing space 17 is formed which is recessed into a cuboid shape from the lower surface to a certain midpoint of the head case 16 in a height direction. When the flow path unit 15 described later is joined to a lower surface of the head case 16 with the flow path unit 15 and the head case 16 positioned with respect to each other, the electronic device 14 (a pressure chamber-forming plate 29, a sealing plate 33, and the like) stacked on a communicating plate 24 is housed in the housing space 17 in this configuration.

The flow path unit 15 joined to the lower surface of the head case 16 includes the communicating plate 24 and the nozzle plate 21. The communicating plate 24 is a plate member made of silicon. In this embodiment, the communicating plate 24 is made of a single crystal silicon substrate with the crystal plane orientation on each surface (upper surface and lower surface) being (110) plane. In this communicating plate 24, as shown in FIG. 2, common liquid chambers 25 and individual communicating paths 26 are formed by etching. The common liquid chambers 25 communicate with the reservoirs 18 and store ink common to the pressure chambers 30. The individual communicating paths 26 supply the ink from the reservoirs 18 through the common liquid chambers 25 individually to the pressure chambers 30. Each of the common liquid chambers 25 is a space portion elongated in a nozzle row direction. Here, two rows of common liquid chambers 25 are formed so as to correspond to the rows of the pressure chambers 30, which are provided side by side in two rows. Each of the common liquid chambers 25 includes a first liquid chamber 25*a* penetrating the communicating plate 24 in a plate thickness direction thereof, and a second liquid chamber 25*b* formed by recessing the communicating plate 24 from a lower surface side toward an upper surface side of the communicating plate 24 to a certain midpoint of the communicating plate 24 in the plate thickness direction, with a thin plate portion left on the upper surface side. The multiple individual communicating paths 26 corresponding to the pressure chambers 30 are formed in the thin plate portion of the second liquid chamber 25*b*, while being arranged in a direction in which the pressure chambers 30 are arranged side by side. When the communicating plate 24 and the pressure chamber-forming plate 29 are joined to each other, each of the individual communicating paths 26 communicates with an end portion of a corresponding one of the pressure chambers 30 on one side in a longitudinal direction of the pressure chamber 30.

In addition, a nozzle communicating path 27 that penetrates the communicating plate 24 in the plate thickness direction is formed at a position in the communicating plate 24 corresponding to each of the nozzles 22. In other words, multiple nozzle communicating paths 27 corresponding to each of the nozzle rows are formed in the nozzle row direction. Through the nozzle communicating paths 27, the pressure chambers 30 and the nozzles 22 communicate with each other. When the communicating plate 24 and the pressure chamber-forming plate 29 are joined to each other, each of the nozzle communicating paths 27 of this embodiment communicates with an end portion of the corresponding one of the pressure chambers 30 on the other side (on a side opposite from the individual communicating path 26) in the longitudinal direction.

The nozzle plate 21 is a silicon plate (for example, a single crystal silicon substrate) joined to a lower surface (a surface on a side opposite from the pressure chamber-forming plate 29) of the communicating plate 24. In this embodiment, this nozzle plate 21 seals openings of spaces on a lower surface side serving as the common liquid chambers 25. In addition, in the nozzle plate 21, the multiple nozzles 22 are opened on straight lines (in rows). In this embodiment, two nozzle rows are formed corresponding to the rows of the pressure chambers 30 formed in the two rows. The multiple nozzles 22 arranged side by side (nozzle rows) are provided at regular intervals in the sub-scanning direction perpendicular to the main scanning direction from one of the nozzles 22 on one end side to one of the nozzles 22 on another end side with a pitch (for example, 600 dpi) corresponding to a dot formation density. Note that it is also possible to join the nozzle plate to a region of the communicating plate inside the common liquid chambers, and seal openings on the lower surface side of the spaces to form the common liquid chambers with, for example, flexible members such as compliance sheets. With this configuration, the nozzle plate can be made as small as possible.

The electronic device 14 of this embodiment is a thin plate-shaped device functioning as an actuator that causes change in pressure of the ink in each of the pressure chambers 30. As shown in FIG. 2, the pressure chamber-forming plate 29, a vibration plate 31, piezoelectric elements 32 (equivalent to driving elements according to the invention), the sealing plate 33, and a drive IC 34 are stacked together and unitized into the electronic device 14. Note that the electronic device 14 is formed to be smaller than the housing space 17, so that the electronic device 14 can be housed in the housing space 17.

The pressure chamber-forming plate 29 is a hard plate member made of silicon. In this embodiment, the pressure chamber-forming plate 29 is made of a single crystal silicon substrate with the crystal plane orientation on each surface (upper surface and lower surface) being (110) plane. Some portions of the pressure chamber-forming plate 29 are removed by etching completely in the plate thickness direction to form multiple spaces to serve the pressure chambers 30 arranged side by side in the nozzle row direction. A lower portion of each of the spaces is defined by the communicating plate 24, and an upper portion of each of the spaces is defined by the vibration plate 31. In this manner, the spaces constitute the pressure chambers 30. In addition, the spaces, i.e., the pressure chambers 30 are formed in two rows corresponding to the rows of the nozzles formed in the two rows. Each of the pressure chambers 30 is a space portion elongated in a direction perpendicular to the nozzle row direction. The end portion of the pressure chamber 30 on the one side in the longitudinal direction communicates with the individual communicating path 26, and another end portion of the pressure chamber 30 on the other side communicates with the nozzle communicating path 27.

The vibration plate 31 is a thin film-shaped elastic member, and is stacked on an upper surface (a surface on a side opposite from the communicating plate 24) of the pressure chamber-forming plate 29. The vibration plate 31 seals upper openings of the spaces to serve as the pressure chambers 30. In other words, the vibration plate 31 defines the pressure chambers 30. Portions in the vibration plate 31 corresponding to the pressure chambers 30 (specifically, the upper openings of the pressure chambers 30) function as displacement portions that are displaced in a direction leaving from the nozzles 22 or in a direction approaching the nozzles 22 with the flexural deformation of the piezoelectric elements 32. In other words, regions in the vibration plate 31 corresponding to the upper openings of the pressure chambers 30 serve as drive regions 35 where the flexural deformation is allowed. On the other hand, regions in the vibration plate 31 not on the upper openings of the pressure chambers 30 serve as non-drive regions 36 where the flexural deformation is inhibited.

Note that the vibration plate 31 includes, for example, an elastic film formed on an upper surface of the pressure chamber-forming plate 29 and made of silicon dioxide ($SiO_2$), and an insulation film formed on the elastic film and made of zirconium oxide ($ZrO_2$). In addition, each of the piezoelectric elements 32 is stacked on the insulation film (on a surface of the vibration plate 31 on the side opposite from the pressure chamber-forming plate 29) and in a region corresponding to the corresponding one of the pressure chambers 30, i.e., in the drive region 35. The piezoelectric elements 32 are formed in two rows extending in the nozzle row direction so as to correspond to the two rows of the pressure chambers 30 arranged side by side in the nozzle row direction. Note that the pressure chamber-forming plate 29 and the vibration plate 31 stacked on the pressure chamber-forming plate 29 are equivalent to a driving element-forming plate according to the invention.

Each of the piezoelectric elements 32 of this embodiment is a piezoelectric element of a so-called flexural mode. The piezoelectric element 32 includes, for example, a lower electrode layer, a piezoelectric layer, and an upper electrode layer sequentially stacked on the vibration plate 31. When an electric field is applied across the lower electrode layer and the upper electrode layer according to the potential difference between the two electrodes, the thus configured piezoelectric element 32 undergoes flexural deformation in a direction leaving from or approaching the nozzle 22. As shown in FIG. 2, the lower electrode layer constituting the piezoelectric element 32 is formed to extend to a non-drive region 36 outside the piezoelectric element 32, and constitutes an individual wire 37 that supplies an individual voltage to the corresponding one of the piezoelectric elements 32. On the other hand, the upper electrode layer constituting the piezoelectric element 32 is formed to extend to another non-drive region 36 between the rows of the piezoelectric elements 32, and constitutes the common wire 38 (equivalent to a common electrode of the invention) that supplies a voltage common to the piezoelectric elements 32. In other words, in the longitudinal direction of the piezoelectric element 32, the individual wire 37 is formed on an outside of the piezoelectric element 32, and the common wire 38 is formed on an inside of the piezoelectric element 32. In addition, resin core bumps 40 (described later) are joined correspondingly to the individual wire 37 and the common wire 38.

Note that, in this embodiment, a common wire 38 formed to extend from a row of the piezoelectric elements 32 on one side and another common wire 38 formed to extend from the row of the piezoelectric elements 32 on the other side are connected to each other in the non-drive region 36 between the rows of the piezoelectric elements 32. In other words, as shown in FIGS. 2 and 4, a common wire 38 common to the piezoelectric elements 32 on both sides is formed in the non-drive region 36 between the rows of the piezoelectric elements 32. As shown in FIG. 4, the common wire 38 is provided to extend in a direction in which the rows of the piezoelectric elements 32 are formed (i.e., the nozzle row direction).

As shown in FIG. 2, the sealing plate 33 (equivalent to a wiring plate according to the invention) is a flat-plate shaped silicon plate arranged with a space provided between the sealing plate 33 and the vibration plate 31 (or the piezoelectric element 32). In this embodiment, the sealing plate 33 is formed of a single crystal silicon substrate with crystal plane orientation on each surface (upper surface and lower surfaces) being (110) plane. On a second surface 42 (upper surface) of the sealing plate 33 on a side opposite from a first surface 41 (lower surface), which is a surface on the vibration plate 31 side, a drive IC 34 that outputs signals for driving the piezoelectric elements 32 is arranged. In other words, the vibration plate 31 on which the piezoelectric elements 32 are stacked is connected to the first surface 41 of the sealing plate 33, whereas the drive IC 34 is provided on the second surface 42 of the sealing plate 33.

In this embodiment, the multiple resin core bumps 40 (equivalent to bump electrodes of the invention) are formed on the first surface 41 of the sealing plate 33. The resin core bumps 40 output drive signals from the drive IC 34 and the like to the piezoelectric elements 32. As shown in FIG. 2, multiple resin core bumps 40 are arranged in the nozzle row direction at each of a position corresponding to the individual wires 37 on one side formed to extend to the outside of the piezoelectric elements 32 on the one side, a position corresponding to the individual wires 37 on the other side formed to extend to the outside of the piezoelectric elements 32 on the other side, and a position corresponding to the common wire 38 which is common to the piezoelectric elements 32 and which is formed between the two rows of the piezoelectric elements 32. In addition, each of the resin core bumps 40 is connected to the corresponding one of the individual wires 37 and the common wire 38.

In this embodiment, each of the resin core bumps 40 has elasticity, and is formed to protrude from the surface of the sealing plate 33 toward the vibration plate 31. Specifically, as shown in FIGS. 2 to 4, the resin core bump 40 includes an inner resin 40*a* (equivalent to a resin of the invention) having elasticity and a conductive film 40*b* (equivalent to a conductive layer of the invention) made of a lower surface-side wire 47 covering at least part of a surface of the inner resin 40*a*. The inner resin 40*a* is formed on the surface of the sealing plate 33 like a protrusion elongated in the nozzle row direction. In addition, the multiple conductive films 40*b* electrically connected to the individual wires 37 are formed in the nozzle row direction so as to correspond to the piezoelectric elements 32 arranged side by side in the nozzle row direction. In other words, multiple resin core bumps 40 electrically connected to the individual wires 37 are formed in the nozzle row direction. Each of the conductive films 40*b* extends inwardly from a portion on the inner resin 40*a* (toward the piezoelectric element 32) to form the lower surface-side wire 47. In addition, an end portion of the lower surface-side wire 47 on a side opposite from the resin core bump 40 is connected to a penetrating wire 45 described later.

As shown in FIG. 3, the resin core bumps 40 corresponding to the common wire 38 are stacked on the lower surface-side embedded wire 51 (equivalent to wiring of the invention) formed on the first surface 41 to connect the lower surface-side embedded wire 51 to the common wire 38. Here, the lower surface-side embedded wire 51 is at least partially embedded in the sealing plate 33. In this embodiment, the lower surface-side embedded wire 51 is, as shown in FIG. 4, provided to extend in a direction in which each of the rows of the piezoelectric elements 32 extends (i.e., the nozzle row direction), and embedded entirely in the sealing plate 33. For this reason, a surface of the lower surface-side embedded wire 51 on the first surface 41 side and a surface of the sealing plate 33 on the first surface 41 side are substantially flush. An end portion of the lower surface-side embedded wire 51 in an extending direction thereof is connected to an end portion of the penetrating wire 45 on the first surface 41 side. The penetrating wire 45 is connected to a common connection terminal 55 through a connection wire 62 including an upper surface-side wire 46 formed on the second surface 42 side. In other words, the lower surface-side embedded wire 51 is connected to the common connection terminal 55 through the penetrating wire 45 and the connection wire 62. In addition, to the common connection terminal 55, a corresponding terminal of a wiring plate (not-illustrated) such as a flexible cable is connected, and a voltage common to the piezoelectric elements 32 is supplied. Note that the configuration of the connection between the terminal of the wiring plate such as a flexible cable and the lower surface-side embedded wire is not limited to the above-described one, but various configurations may be employed. For example, it is also possible to connect the terminal of the wiring plate to the lower surface-side wire by connecting the wiring plate on the first surface side without providing any penetrating wire.

In addition, in this embodiment, the multiple resin core bumps 40 electrically connected to the common wire 38 are formed on the lower surface-side embedded wire 51. The lower surface-side embedded wire 51 and the common wire 38 are connected to each other thorough these multiple resin core bumps 40. Specifically, the inner resin 40*a* of the resin core bumps 40 has a width narrower than a width of the lower surface-side embedded wire 51 (a dimension in the direction perpendicular to the nozzle row direction), and is formed to extend in an extending direction of the lower surface-side embedded wire 51. As shown in FIG. 3, the inner resin 40*a* of this embodiment is formed to be overlapped with a substantially center portion of a surface of the lower surface-side embedded wire 51 in a width direction thereof. The multiple conductive films 40*b* of the resin core bumps 40 are arranged in the nozzle row direction on the inner resin 40*a*. In addition, each of the conductive films 40*b* is formed to extend from a position overlapped with the inner resin 40*a* to both sides of the inner resin 40*a* in the width direction thereof to be electrically connected to the lower surface-side embedded wire 51. In other words, the lower surface-side wire 47 (equivalent to a metal layer of the invention) covering the first surface 41 side of the lower surface-side embedded wire 51 on both sides of the inner resin 40*a* is formed to extend to a position overlapped with the inner resin 40*a* to constitute the conductive film 40*b* of the resin core bump 40. Note that the inner resin 40*a* used is, for example, a resin such as a polyimide resin. Meanwhile, for the lower surface-side embedded wire 51, a metal such as copper (Cu) is used. Moreover, the conductive films 40*b* are preferably made of a conductive material different from that of the lower surface-side embedded wire 51, and a metal such as gold (Au) is used.

In addition, as shown in FIG. 2, multiple power supply wires 53 (four wires in this embodiment) are formed on the second surface 42 in a center portion of the sealing plate 33. The power supply wires 53 supply power voltages and the like (for example, VDD1 (power supply of a low-voltage circuit), VDD2 (power supply of a high-voltage circuit), VSS1 (power supply of a low-voltage circuit), and VSS2

(power supply of a high-voltage circuit)) to the drive IC 34. Each of the power supply wires 53 includes an upper surface-side embedded wire 50 embedded in the second surface 42 of the sealing plate 33, and an upper surface-side wire 46 stacked to cover the upper surface-side embedded wire 50. A corresponding power supply terminal 56 of the drive IC 34 is electrically connected onto the upper surface-side wire 46 of the power supply wire 53. Note that the upper surface-side embedded wire 50 is made of a metal such as copper (Cu).

Moreover, as shown in FIG. 2, individual connection terminals 54 are formed in regions on both end sides on the second surface 42 of the sealing plate 33 (in regions outside the region in which the power source wires 53 are formed). To the individual connection terminals 54, individual bump electrodes 57 of the drive IC 34 are connected, and signals from the drive IC 34 are inputted. The multiple individual connection terminals 54 are formed in the nozzle row direction so as to correspond to the piezoelectric elements 32. The upper surface-side wire 46 is formed to extend inwardly from each of the individual connection terminals 54 (toward the piezoelectric element). An end portion of the upper surface-side wire 46 on a side opposite from the individual connection terminal 54 is connected to the corresponding one of the lower surface-side wires 47 through a penetrating wire 45 described later.

As shown in FIG. 2, the penetrating wire 45 is a wire that provides connection between the first surface 41 and the second surface 42 of the sealing plate 33. The penetrating wire 45 includes a through hole 45*a* penetrating the sealing plate 33 in the plate thickness direction and a conductor portion 45*b* formed inside the through hole 45*a* and made of a conductor such as a metal. The conductor portion 45*b* of this embodiment is made of a metal such as copper (Cu), and filled in the through hole 45*a*. A portion of the conductor portion 45*b* exposed to an opening portion of the through-hole 45*a* on the first surface 41 side is covered with the corresponding one of the lower surface-side wires 47 or the lower surface-side embedded wire 51. On the other hand, a portion of the conductor portion 45*b* exposed to an opening portion of the through-hole 45*a* on the second surface 42 side is covered with the corresponding one of the upper surface-side wires 46. In this embodiment, as shown in FIG. 2, the penetrating wire 45 provides electrical connection between one of the upper surface-side wires 46 formed to extend from the individual connection terminal 54 and the corresponding one of the lower surface-side wires 47 formed to extend from the resin core bump 40. In other words, a series of wires including the upper surface-side wire 46, the penetrating wire 45, and the lower surface-side wire 47 connect one of the individual connection terminals 54 to the corresponding one of the resin core bumps 40. In addition, as shown in FIG. 4, the penetrating wire 45 formed in an end portion of the sealing plate 33 in the longitudinal direction provides electrical connection between the lower surface-side embedded wire 51 and the common connection terminal 55. In other words, a series of wires including the connection wire 62, the penetrating wire 45, and the lower surface-side embedded wire 51 connect the common connection terminal 55 to the corresponding ones of the resin core bumps 40. Note that the conductor portion 45*b* of the penetrating wire 45 does not have to be filled in the through-hole 45*a*, but may be formed in at least part of the through-hole 45*a*.

As shown in FIGS. 2 and 3, the sealing plate 33 and the pressure chamber-forming plate 29 (specifically, the pressure chamber-forming plate 29 on which the vibration plate 31 and the piezoelectric elements 32 are stacked) are joined to each other by a photosensitive adhesive agent 43 having both thermosetting and photosensitive properties, with the resin core bumps 40 interposed therebetween. In this embodiment, pieces of the photosensitive adhesive agent 43 are formed on both sides of each of the resin core bumps 40 in the direction perpendicular to the nozzle row direction. In addition, each of the pieces of the photosensitive adhesive agent 43 is formed away from the resin core bumps 40 like a band extending in the nozzle row direction. Note that, as the photosensitive adhesive agent 43, for example, a resin mainly containing an epoxy resin, an acrylic resin, a phenolic resin, a polyimide resin, a silicone resin, a styrene resin, or the like is preferably used.

The drive IC 34 is an IC chip that outputs signals for driving the piezoelectric elements 32, and is stacked on the second surface 42 of the sealing plate 33 with an adhesive agent 59 such as an anisotropic conductive film (ACF) interposed therebetween. As shown in FIG. 2, on a surface of the drive IC 34 on the sealing plate 33 side, the multiple power supply bump electrodes 56 connected to the power source wires 53 and the multiple individual bump electrodes 57 connected to the individual connection terminals 54 are provided side by side in the nozzle row direction. The power supply bump electrodes 56 are terminals through which a voltage (power) from the power source wires 53 is introduced into a circuit in the drive IC 34. Meanwhile, the individual bump electrodes 57 are terminals that output individual signals corresponding to the piezoelectric elements 32. The individual bump electrodes 57 of this embodiment are formed in two rows on both sides of the power supply bump electrodes 56 so as to correspond to the rows of the piezoelectric elements 32, which are provided side by side in two rows. Note that, a distance (i.e., pitch) between centers of every adjacent two of the individual bump electrodes 57 in the rows of the individual bump electrodes 57 is set to be as small as possible. In this embodiment, the individual bump electrodes 57 are formed at a pitch smaller than a pitch of the resin core bumps 40 corresponding to the individual wires 37.

In the recording head 3 formed as described above, the ink from the ink cartridge 7 is introduced to the pressure chambers 30 through the ink introducing paths, the reservoirs 18, the common liquid chambers 25, and the individual communicating paths 26. In this state, drive signals from the drive IC 34 are supplied to the piezoelectric elements 32 through the wires formed on and in the sealing plate 33 to drive the piezoelectric elements 32 and cause changes in pressure in the pressure chambers 30. By utilizing the changes in pressure, the recording head 3 jets ink droplets from the nozzles 22 through the nozzle communicating paths 27.

As described above, in the recording head 3 of this embodiment, the lower surface-side embedded wire 51 formed on the sealing plate 33 is embedded in the sealing plate 33. Hence, the cross-sectional area of the lower surface-side embedded wire 51 can be increased without increasing the width of the lower surface-side embedded wire 51 or the dimension (height) of the lower surface-side embedded wire 51 from the surface of the sealing plate 33. This makes it possible to lower the resistance of the lower surface-side embedded wire 51. In addition, since the width of the lower surface-side embedded wire 51 can be made as small as possible, the degree of freedom of the wiring layout increases and, in turn, the wiring region can be made smaller. Consequently, the size-reduction of the sealing plate 33 can be achieved and, in turn, the size-reduction of the recording head 3 can be achieved. Moreover, since the height of the lower surface-side embedded wire 51 can be made smaller, it is possible to suppress the disadvantageous inhibition of the deformation of the piezoelectric elements 32, even when the lower surface-side embedded wire 51 is arranged at a position overlapped with the piezoelectric elements 32. In this embodiment, the surface of the lower surface-side embedded wire 51 on the first surface 41 side and the surface of the sealing plate 33 on the first surface 41 side are made substantially flush. Hence, it is possible to make the heights of the resin core bumps 40 electrically connected to the individual wires 37 from the surface of the sealing plate 33 equal to the heights of the resin core bumps 40 electrically connected to the common wire 38 from the surface of the sealing plate 33. This enables the sealing plate 33 and the pressure chamber-forming plate 29 to be easily joined to each other.

In addition, portions on the first surface 41 side of the lower surface-side embedded wire 51 on both sides of the resin core bump 40 are covered with the lower surface-side wire 47 (the conductive film 40*b*). Hence, it is possible to suppress change in electrical characteristics of the lower surface-side embedded wire 51 due to environmental change. It is also possible to suppress a break of the lower surface-side embedded wire 51 due to migration or the like. This makes it possible to provide the recording head 3 with a high reliability. Moreover, the lower surface-side embedded wire 51 and the common wire 38 are connected to each other by the multiple resin core bumps 40. Hence, it is possible to suppress concentration of power supplied to the common wire 38 on one point. This makes it possible to suppress the variation in the power supplied to the piezoelectric elements 32 through the common wire 38. Consequently, jetting characteristics of the ink jetted through the nozzles 22 can be made uniform.

In addition, in the above-described configuration, the resin core bumps 40 include the inner resin 40*a* having elasticity and the conductive films 40*b* covering the surface of the inner resin 40*a*. Hence, the resin core bumps 40 can be provided with elasticity, and more reliable electrical connection can be provided by the resin core bumps 40. Moreover, the inner resin 40*a* is formed on the surface of the lower surface-side embedded wire 51. Hence, it is possible to further suppress change in electrical characteristics of the lower surface-side embedded wire 51 due to environmental change. In addition, it is possible to further suppress a break of the lower surface-side embedded wire 51 due to migration or the like. Moreover, the resin core bumps 40 are formed just on the lower surface-side embedded wire 51. Hence, the wiring distance of the conductive film 40*b* can be shortened, and the resistance of the wiring can be lowered in comparison with a case where bump electrodes such as resin core bumps are provided separately from the lower surface-side embedded wire 51. In addition, the conductive films 40*b* are formed of the lower surface-side wires 47. Hence, the conductive films 40*b* and the lower surface-side wires 47 covering the lower surface-side embedded wire 51 can be formed in the same step. Consequently, the sealing plate 33 becomes easier to manufacture, and the sealing plate 33 can be formed at low costs. In addition, the sealing plate 33 includes the penetrating wires 45 each including the conductor portion 45*b* formed inside the through-hole 45*a* penetrating the sealing plate 33. Hence, connection between the first surface 41 and the second surface 42 can be provided at any position in the sealing plate 33. In addition, since wires can be formed on both surfaces of the sealing plate 33, the degree of freedom of the wiring layout can be increased.

Next, a method for manufacturing the above-described recording head 3, especially, the sealing plates 33 is described. The electronic device 14 of this embodiment is obtained as follows. Specifically, a single crystal silicon substrate (silicon wafer) in which multiple regions each serving as the sealing plate 33 are formed is joined to a single crystal silicon substrate (silicon wafer) in which multiple regions each serving as the pressure chamber-forming plate 29 including the vibration plate 31 and the piezoelectric elements 32 stacked thereon are formed. Then, the drive IC 34 is joined at each of the corresponding positions. After that, the stack is cut into pieces.

More specifically, the single crystal silicon substrate 33' including the sealing plates 33 is first subjected to a photolithography step and an etching step in wiring plate processing. In the wiring plate processing, recessed portions 64, which are used to form the upper surface-side embedded wires 50 and the lower surface-side embedded wires 51, are formed on both surfaces of the single crystal silicon substrate 33', and also the through-holes 45*a* penetrating the sealing plate 33 are formed. Specifically, any one surface of the single crystal silicon substrate 33' is subjected to patterning using a photoresist and then dry etched to form some of the recessed portions 64 recessed in the plate thickness direction. Likewise, the other surface is subjected to patterning using a photoresist and then dry etched to form the others of the recessed portions 64 recessed in the plate thickness direction (see FIG. 5(*a*)). Next, portions of the surfaces of the single crystal silicon substrate 33' where the through-holes 45*a* are to be formed are exposed by patterning using a photoresist. Subsequently, these exposed portions are dry etched in the plate thickness direction to form the through-holes 45*a*. After that, the photoresist is detached, and an insulating film (not-illustrated) is formed on a sidewall of each of the through-holes 45*a* (see FIG. 5(*b*)). Note that, as a method for forming the insulating film, various methods can be employed such as a CVD method, a method in which a silicon oxide film is formed by thermal oxidation, and a method in which a resin is applied and then cured.

Next, in wiring formation, a conductive material 65 is embedded in the recessed portions 64 to form the upper surface-side embedded wires 50 and the lower surface-side embedded wires 51, and the conductive material 65 is also embedded in through-holes 45*a* to form the penetrating wires 45. Specifically, the conductive material 65 to be the upper surface-side embedded wires 50, the lower surface-side embedded wires 51, and the conductor portions 45*b* of the penetrating wires 45 is formed on both surfaces of the single crystal silicon substrate 33' and in the through-holes 45*a* by an electrolytic plating method. In other words, a seed layer used to form the conductive material 65 is formed, and the conductive material 65 is formed by electrolytic copper plating using the seed layer as an electrode (see FIG. 5(*c*)). Note that it is preferable to form a film that improves adhesion to the substrate and barrier properties under the seed layer. In addition, the seed layer is preferably a layer of copper (Cu) formed by a sputtering method or a CVD method, and the adhesion film or the barrier film is preferably a film of titanium (Ti), titanium nitride (TiN), titanium tungsten (TiW), tantalum (Ta), tantalum nitride (TaN), or the like formed by a sputtering method or a CVD method.

Next, the conductive material 65 (copper (Cu)) deposited on the upper surface of the single crystal silicon substrate 33' is removed by a CMP (chemical mechanical polishing) method to expose the surface of the single crystal silicon substrate 33'. In addition, the lower surface of the single crystal silicon substrate 33' is removed to a predetermined thickness by a back grinding method or the like, and finally the single crystal silicon substrate 33' is ground by employing a CMP method or the like to expose the conductor portions 45*b* of the penetrating wires 45 (see FIG. 6(*a*)). In this manner, the upper surface-side embedded wires 50, the lower surface-side embedded wires 51, and the penetrating wires 45 are formed in the single crystal silicon substrate 33'. After these wires 50, 51, and 45 are formed, an insulating film (not-illustrated) such as a silicon oxide film is formed on the lower surface of the single crystal silicon substrate 33'. Then, after patterning using a photoresist, the lower surface-side embedded wires 51 and the penetrating wires 45 are exposed by dry etching or wet etching, and then the photoresist is detached. After that, a resin film is formed on the lower surface of the single crystal silicon substrate 33', and the inner resin 40*a* is formed by a photolithography step and an etching step. Then, the inner resin 40*a* is melted by heating to round corners of the inner resin 40*a* (see FIG. 6(*b*)).

After the inner resin 40*a* is formed, a rewiring layer made of a conductive material different from the conductive material 65 is formed on the entire upper surface of the single crystal silicon substrate 33' in a front-layer wiring formation step. Then, the rewiring layer is patterned in a photolithography step and an etching step to form the upper surface-side wires 46 including portions covering the upper surface-side embedded wires 50. Likewise, another rewiring layer made of a conductive material different from the conductive material 65 is formed on the entire lower surface of the single crystal silicon substrate 33'. Then, the rewiring layer is patterned in a photolithography step and an etching step to form the lower surface-side wires 47 including portions covering the lower surface-side embedded wires 51. Note that since the conductive films 40*b* are also formed simultaneously with the lower surface-side wires 47, the resin core bumps 40 are also formed (see FIG. 6(*c*)). Thus, multiple regions each of which is to be the sealing plate 33 corresponding to the recording head 3 are formed in the single crystal silicon substrate 33'. Note that, regarding materials of the rewiring layer, a topmost surface of the rewiring layer is preferably formed of gold (Au). However, the material of the rewiring layer is not limited thereto, but the rewiring layer may be formed by using any generally used material (such as Ti, Al, Cr, Ni, or Cu). In addition, the method for forming the upper surface-side wires 46, the lower surface-side wires 47, and the penetrating wires 45 in the sealing plates 33 is not limited to the above-described method, but it is also possible to form them by any generally employable manufacturing method.

On the other hand, regarding the single crystal silicon substrate including the pressure chamber-forming plates 29, first, the vibration plate 31 is stacked on a surface (a surface on a side facing the sealing plate 33) of the single crystal silicon substrate. Next, a lower electrode layer including the individual wires 37, a piezoelectric layer, an upper electrode layer including the common wire 38, and the like are sequentially patterned by a semiconductor process to form the piezoelectric elements 32. In this manner, multiple regions each of which is to be the pressure chamber-forming plate 29 corresponding to the recording head 3 are formed in the single crystal silicon substrate. Then, after the sealing plates 33 and the pressure chamber-forming plates 29 are formed in these single crystal silicon substrates, a photosensitive adhesive layer is formed on a surface (a surface on the sealing plate 33 side) of the single crystal silicon substrate including the pressure chamber-forming plates 29. Then, pieces of the photosensitive adhesive agent 43 are formed in predetermined positions by a photolithography step. Specifically, a liquid photosensitive adhesive agent having photo-sensitivity and thermosetting properties is applied onto the vibration plate 31 by using a spin coater or the like, followed by heating. In this manner, the photosensitive adhesive layer is formed. By subsequent exposure and development, the shapes of the photosensitive adhesive agent 43 are patterned at the predetermined positions.

After the pieces of the photosensitive adhesive agent 43 are formed, the two single crystal silicon substrates are joined. Specifically, one of the single crystal silicon substrates is moved toward and relative to the other one of the single crystal silicon substrates and bonded to each other, with the photosensitive adhesive agent 43 interposed between the two single crystal silicon substrates. In this state, a pressure is applied to the two single crystal silicon substrates in the vertical direction against the elastic restoring force of the resin core bumps 40. As a result, the resin core bumps 40 are compressed, and are surely electrically connected to the individual wires 37, the common wire 38, and the like on the pressure chamber-forming plate. Then, the substrates are heated under pressure to a curing temperature of the photosensitive adhesive agent 43. Consequently, the photosensitive adhesive agent 43 is cured, and the two single crystal silicon substrates are joined, with the resin core bumps 40 being compressed.

After the two single crystal silicon substrates are joined, the single crystal silicon substrate including the pressure chamber-forming plates 29 is polished from the lower surface side (the side opposite from the single crystal silicon substrate including the sealing plates 33) to thin the single crystal silicon substrate including the pressure chamber-forming plates 29. After that, the pressure chambers 30 are formed in the thinned single crystal silicon substrate including the pressure chamber-forming plates 29 by a photolithography step and an etching step. Then, the drive IC 34 is joined to the upper surface of the single crystal silicon substrate including the sealing plates 33 by using the adhesive agent 59. Finally, the stack is broken into individual electronic devices 14 along predetermined scribe lines. Note that, in the above-described method, the electronic devices 14 are fabricated by joining the two single crystal silicon substrates to each other and then cutting the substrates into the pieces. However, the invention is not limited thereto. For example, it is also possible to cut each of the two single crystal silicon substrates into pieces of the sealing plates 33 or the pressure chamber-forming plates 29, and then join the sealing plates 33 and the pressure chamber-forming plates 29 to each other. Moreover, it is also possible to cut each of the single crystal silicon substrates into pieces and then form the sealing plates 33 and the pressure chamber-forming plates 29 in the pieces of the substrates.

Then, each of the electronic devices 14 manufactured by the above-described process is positioned with respect to and fixed to the flow path unit 15 (communicating plate 24) by using an adhesive agent or the like. Then, with the electronic device 14 housed in the housing space 17 of the head case 16, the head case 16 and the flow path unit 15 are joined to each other. In this manner, the above-described recording head 3 is manufactured.

As described above, the recessed portions 64 recessed in the plate thickness direction are formed, and the conductive material 65 is embedded in the recessed portions 64. Hence, the lower surface-side embedded wire 51 embedded in the sealing plate 33 can be formed. This makes it possible to increase the cross-sectional area of the lower surface-side embedded wire 51 without increasing the width of the lower surface-side embedded wire 51 or the dimension (height) of the lower surface-side embedded wire 51 from the surface of the sealing plate 33. Consequently, the resistance of the lower surface-side embedded wire 51 can be lowered. In addition, since the lower surface-side embedded wire 51 and the penetrating wires 45 can be formed in the same step, the sealing plate 33 can be easily manufactured. Moreover, the sealing plate 33 can be formed at low costs. In addition, the conductive material 65 is formed in the recessed portions 64 and in the through-holes 45*a* by employing an electrolytic plating method. Hence, the power source wires 53 and the penetrating wires 45 can be formed more easily. Consequently, the sealing plate 33 becomes much easier to manufacture. In addition, the sealing plate 33 can be fabricated at lower costs.

In the first embodiment described above, portions of the lower surface-side embedded wire 51 on both sides of each of the resin core bumps 40 is covered with the lower surface-side wire 47. However, the invention is not limited to this configuration. For example, the entirety of the region of the lower surface-side embedded wire not overlapped with the inner resin of the resin core bump may be covered with the lower surface-side wire. With this configuration, it is possible to further suppress a break of the lower surface-side embedded wire or change in electrical characteristics of the lower surface-side embedded wire. In addition to this, it is also possible to cover the entire surface of the inner resin with the lower surface-side embedded wire. In other words, the entirety of the lower surface-side embedded wire including the region overlapped with the inner resin may be covered with the lower surface-side embedded wire.

In addition, the conductive material 65 is formed in the recessed portions 64 and in the through-holes 45*a* by an electrolytic copper plating method in the wiring formation in the manufacturing method of the first embodiment. However, the invention is not limited thereto. For example, the conductive material may be formed by embedding a material capable of providing electrical conduction in vertical direction in the recessed portions and in the through-holes by employing a method such as electroless plating or printing. Note that, for the printing, various methods can be employed such as a method in which an electrically conductive paste is applied with a dispenser, a method in which a printing plate is stacked on a single crystal silicon substrate and an electrically conductive paste is applied with a squeegee, a method in which an electrically conductive paste temporarily applied onto a film or the like is transferred onto a single crystal silicon substrate, and the like. In addition, the electrically conductive paste arranged in the recessed portions and in the through-holes by the printing is hardened by a treatment such as heating. In other words, the wiring formation in this case includes hardening the electrically conductive paste. Note that a silver paste containing silver (Ag) or the like is preferably used as the electrically conductive paste.

By forming the conductive material in the recessed portions and in the through-holes by printing as described above, the lower surface-side embedded wires and the penetrating wires can be formed more easily. Consequently, the sealing plate becomes much easier to manufacture. In addition, the sealing plate can be fabricated at lower costs. Moreover, when an electrically conductive paste is employed as the conductive material, the resistance of the lower surface-side embedded wires and the penetrating wires can be lowered.

Moreover, in the first embodiment, the inner resin 40*a* of the resin core bumps 40 is formed on the lower surface-side embedded wire 51. However, the invention is not limited thereto. For example, in a second embodiment shown in FIG. 7, resin core bumps 40' are formed between two lower surface-side embedded wires 51'. The resin core bumps 40' are electrically connected to the two lower surface-side embedded wires 51'. The two lower surface-side embedded wires 51' are electrically connected to the common wire 38' by the resin core bumps 40'.

Specifically, as shown in FIG. 7, an inner resin 40*a*' is formed on the surface (the first surface 41) of the sealing plate 33 between the two lower surface-side embedded wires 51', and both sides of a conductive film 40*b*' in the width direction of the inner resin 40*a*' are connected to the lower surface-side embedded wires 51'. In this embodiment, the two rows of lower surface-side embedded wires 51' are formed on both sides in a region where at least the resin core bumps 40' are formed but the inner resin 40*a*' is not formed. Each of the lower surface-side embedded wires 51' is formed to extend in the nozzle row direction, and the entire surface of the lower surface-side embedded wire 51' on the first surface 41 side is covered with the lower surface-side wire 47'. Specifically, the number of the lower surface-side wires 47' provided is also two rows. In addition, portions of the lower surface-side wires 47' on both sides are formed to extend onto the inner resin 40*a*' to constitute the conductive film 40*b*'. In other words, the conductive film 40*b*' stacked on the inner resin 40*a*' is formed to extend to positions overlapped with the lower surface-side embedded wires 51' on both sides to form the lower surface-side wire 47' covering the lower surface-side embedded wires 51'. For this reason, the lower surface-side embedded wires 51' on both sides share the same electric potential. Note that descriptions of other constituents, which are the same as those in the first embodiment, are omitted.

In this embodiment, the inner resin 40*a*' is formed at a position offset from the lower surface-side embedded wires 51' as described above. Hence, the adhesion between the inner resin 40*a*' and the sealing plate 33 can be improved. Note that it is also possible to further improve the adhesion between the inner resin 40*a*' and the sealing plate 33 by additionally forming an adhesion layer in the region on the sealing plate 33 where the inner resin 40*a*' is stacked. In addition, since the conductive film 40*b*' is formed of the lower surface-side wire 47' also in this embodiment, the conductive film 40*b*' and the lower surface-side wire 47' covering the lower surface-side embedded wires 51' can be formed in the same step. Consequently, the sealing plate 33 becomes easier to manufacture, and the sealing plate 33 can be formed at low costs. Note that, in this embodiment, the conductive film 40*b*' is connected to the two rows of lower surface-side embedded wires 51' formed on both sides of the inner resins 40*a*'. However, the invention is not limited to this configuration. It is only necessary that the conductive film be connected to at least one of the two rows of lower surface-side embedded wires in a position offset from the inner resin.

In addition, in each of the above-described embodiments, the resin core bumps 40 are provided on the sealing plate 33 side. However, the invention is not limited to this configuration. For example, in a third embodiment shown in FIG. 8, resin core bumps 40" are formed on the vibration plate 31 side.

Specifically, as shown in FIG. 8, an inner resin 40*a*" is formed on the surface of the vibration plate 31 at a position facing a lower surface-side embedded wire 51". In addition, the conductive film 40*b*" is formed by a common wire 38". In other words, the conductive film 40*b*" stacked on the inner resin 40*a*" is formed to extend on both sides in the width direction, and constitutes the common wire 38" to serve as an upper electrode layer of each of the piezoelectric elements 32. In other words, the common wire 38" formed to extend from each of the piezoelectric elements 32 toward the inner resin 40*a*" covers the inner resin 40*a*" and serves as the conductive film 40*b*" of the resin core bump 40". Note that, the lower surface-side embedded wire 51" is formed to extend in the nozzle row direction in the same manner as in the first embodiment. The entire surface of the lower surface-side embedded wire 51" on the first surface 41 side is covered with the lower surface-side wire 47". The resin core bump 40" is connected to the lower surface-side wire 47" to provide electrical connection between the lower surface-side embedded wire 51" and the common wire 38". Note that descriptions of the other constituents, which are the same as those in the first embodiment, are omitted.

As described above, the resin core bumps 40" are formed at positions facing the lower surface-side embedded wire 51" also in this embodiment. Hence, the wiring distance can be shortened, and the resistance of the wiring can be lowered in comparison with a case where bump electrodes such as resin core bumps are connected to terminals provided separately from the lower surface-side embedded wire 51". In addition, the conductive film 40*b*" can be formed of the common wire 38". Hence, the pressure chamber-forming plate 29 becomes much easier to manufacture, and the pressure chamber-forming plate 29 can be fabricated at lower costs in this case than in a case where an additional conductive film is formed.

Moreover, in each of the above-described embodiments, the resin core bumps 40 each including the inner resin 40*a* and the conductive film 40*b* are used as bump electrodes. However, the invention is not limited to this configuration. For example, it is possible to use bump electrodes made of a metal such as gold (Au) or a solder. In addition, in the above-described manufacturing method, the photosensitive adhesive agent 43 is applied onto the single crystal silicon substrate including the pressure chamber-forming plates 29. However, the invention is not limited to thereto. For example, it is also possible to apply the photosensitive adhesive agent onto the single crystal silicon substrate including the sealing plates.

In addition, in the description above, the inkjet-type recording head to be mounted on an inkjet printer is shown as an example of liquid jet head. However, the invention can also be applied to devices that jet a liquid other than ink. For example, the invention can be also applied to coloring material jet heads used for manufacturing color filters of liquid crystal displays and the like, electrode material jet heads used for forming electrodes of organic EL (Electro Luminescence) displays, FEDs (surface emission displays), and the like, bioorganic matter jet heads used for manufacturing biochips (biochemical elements), and the like.

REFERENCE SIGNS LIST

1 printer, 3 recording head, 14 electronic device, 15 flow path unit, 16 head case, 17 housing space, 18 reservoir, 21 nozzle plate, 22 nozzle, 24 communicating plate, 25 common liquid chamber, 26 individual communicating path, 29 pressure chamber-forming plate, 30 pressure chamber, 31 vibration plate, 32 piezoelectric element, 33 sealing plate, 37 individual wire, 38 common wire, 40 resin core bump, 41 first surface, 42 second surface, 43 photosensitive adhesive agent, 45 penetrating wire, 46 upper surface-side wire, 47 lower surface-side wire, 50 upper surface-side embedded wire, 51 lower surface-side embedded wire, 53 power source wire, 54 individual connection terminal, 55 common connection terminal, 56 power supply bump electrode, 57 individual bump electrode, 59 adhesive agent, 62 common wire, 64 recessed portion, 65 conductive material

CITATION LIST

Patent Literature

PTL 1: JP-A-2011-115972

The invention claimed is:

1. A liquid jet head, comprising a wiring plate having a first surface to which a driving element-forming plate including a plurality of driving elements is connected and a second surface which is on a side opposite from the first surface and on which a drive IC that outputs signals for driving the driving elements is provided, wherein wiring connected to a common electrode common to the driving elements is formed on the first surface of the wiring plate, and the wiring is at least partially embedded in the wiring plate and provided to extend in a direction that the plurality of driving elements extend.

2. The liquid jet head according to claim 1, wherein the wiring is at least partially covered with a metal layer.

3. The liquid jet head according to claim 1, wherein the wiring and the common electrode are connected to each other by bump electrodes.

4. The liquid jet head according to claim 3, wherein each of the bump electrodes includes a resin having elasticity and a conductive layer covering at least part of a surface of the resin.

5. The liquid jet head according to claim 4, wherein the resin is formed on a surface of the wiring, and the conductive layer is connected to the wiring at a position offset from the resin.

6. The liquid jet head according to claim 4, wherein the wiring is formed in two rows, the resin is formed between the two rows of the wiring, and the conductive layer is connected to at least one of the two rows of the wiring at a position offset from the resin.

7. The liquid jet head according to claim 4, wherein the resin is formed at a position facing the wiring, and the conductive layer is the common electrode.

8. The liquid jet head according to claim 1, wherein the wiring plate includes a penetrating wire made of a conductor and formed inside a through-hole penetrating the wiring plate, and the wiring is connected to the penetrating wire on the first surface.

* * * * *